US006827235B2

(12) United States Patent
Androsyuk et al.

(10) Patent No.: US 6,827,235 B2
(45) Date of Patent: Dec. 7, 2004

(54) BANKNOTE CASSETTE WITH FOLDABLE HANDLE

(75) Inventors: Sergiy Androsyuk, Thornhill (CA); Mykhaylo Kucherenko, Thornhill (CA)

(73) Assignee: Cashcode Company Inc., Concord (CA)

( * ) Notice: Subject to any disclaimer, the term of this patent is extended or adjusted under 35 U.S.C. 154(b) by 51 days.

(21) Appl. No.: 10/090,812

(22) Filed: Mar. 6, 2002

(65) Prior Publication Data

US 2003/0122300 A1 Jul. 3, 2003

(51) Int. Cl.[7] ..... B65H 1/00

(52) U.S. Cl. ..... 221/197; 271/181

(58) Field of Search ..... 221/197, 154, 221/185, 282; 194/205, 206; 109/45; 271/207

(56) References Cited

U.S. PATENT DOCUMENTS

| | | | | | |
|---|---|---|---|---|---|
| 2,254,506 | A | * | 9/1941 | Wheary, Jr. | 16/409 |
| 3,562,849 | A | * | 2/1971 | Brayshaw | 16/445 |
| 5,012,553 | A | * | 5/1991 | Hardigg et al. | 16/445 |
| 5,411,249 | A | * | 5/1995 | Zouzoulas | 271/181 |
| 5,533,605 | A | * | 7/1996 | Mays et al. | 194/206 |
| 2002/0138948 | A1 | * | 10/2002 | Jen | 16/408 |

* cited by examiner

*Primary Examiner*—Kenneth Noland

(57) ABSTRACT

A banknote cassette includes a generally rectangular casing for receiving and storing banknotes in a stacked manner. The case includes a foldable handle, movable from a storage position to a locked operating position with the handle maintaining the locked operating position. In a preferred aspect, the foldable handle includes two opposed handle segments which cooperate with each other during movement of the handle segments from the storage position to the operating position.

7 Claims, 4 Drawing Sheets

BANKNOTE CASSETTE WITH FOLDABLE HANDLE

FIELD OF THE INVENTION

The present invention relates to removable banknote cassettes used in banknote validators.

BACKGROUND OF THE INVENTION

A number of automated payment systems include banknote cassettes which receive and stack banknotes and allow authorized removal of the cassette from the payment system. Typically the cassette is locked such that access to the stacked banknotes is restricted. The banknote cassettes can be removed and transported to a secure environment where they are unlocked and appropriately processed. When a banknote cassette is removed, a replacement banknote cassette is inserted. In many cases, a series of automated payment devices are being serviced at the same point in time and the banknote cassettes are typically removed and stored in a further device for transport to the secure environment.

Automatic payment systems typically include a banknote validator for confirming the authenticity of a banknote and a drive arrangement for moving the banknote from the validator to the banknote cassette. Preferably, the automatic payment systems are associated with a vending, gaming or other self-serve type device. In many of these applications, the space available within the gaming or vending machine is quite limited and therefore an efficient design and effective space utilization of the automatic payment system is required.

A number of banknote cassettes have been designed with a fixed handle on one face thereof to provide an effective means for manipulating the banknote cassette during insertion of the cassette into an automatic payment system and to allow simple removal of the banknote cassette from such an automatic payment system. Unfortunately, the fixed projecting handle requires additional space within the device which may not be available. Other banknote cassettes have included recessed finger grip portions in the sides of the cassette for of the banknote cassette but the width of the cassette makes this arrangement awkward.

The present invention provides an effective handle arrangement which adds convenience while still effectively utilizing the space available in the related vending, gaming or other device.

SUMMARY OF THE INVENTION

A banknote cassette for storing of banknotes in a stacked manner comprises a generally rectangular case having a slot through which banknotes are received and stacked interior to the case. The case includes a foldable handle secured to a face of the rectangular case. The foldable handle is movable from a storage position generally parallel to the face to a lockable operating position with a handle generally perpendicular to the face.

In a preferred aspect of the invention, the handle includes a bias arrangement for urging the handle to the storage position.

In a further aspect of the invention, the handle in the operating position cooperates with the cassette to lock the handle and maintain the orientation of the handle in a locked position relative to the face. The arrangement also includes a release for the handle allowing movement of the handle from the locked operating position to the storage position.

In yet a further aspect of the invention, the handle includes two opposed handle segments with each segment including a gear portion with the gear portions of opposed handle segments being in mesh. With this arrangement, movement of one handle segment causes a corresponding movement of the other handle segment.

In yet a further aspect of the invention, the handle segments are of the identical construction.

In yet a further aspect of the invention, each handle segment includes a projecting releasable locking tab and a locking recess located such that the projected locking tab of one handle segment is received in the locking recess of the other handle segment when the handle segments are moved to the operating position.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
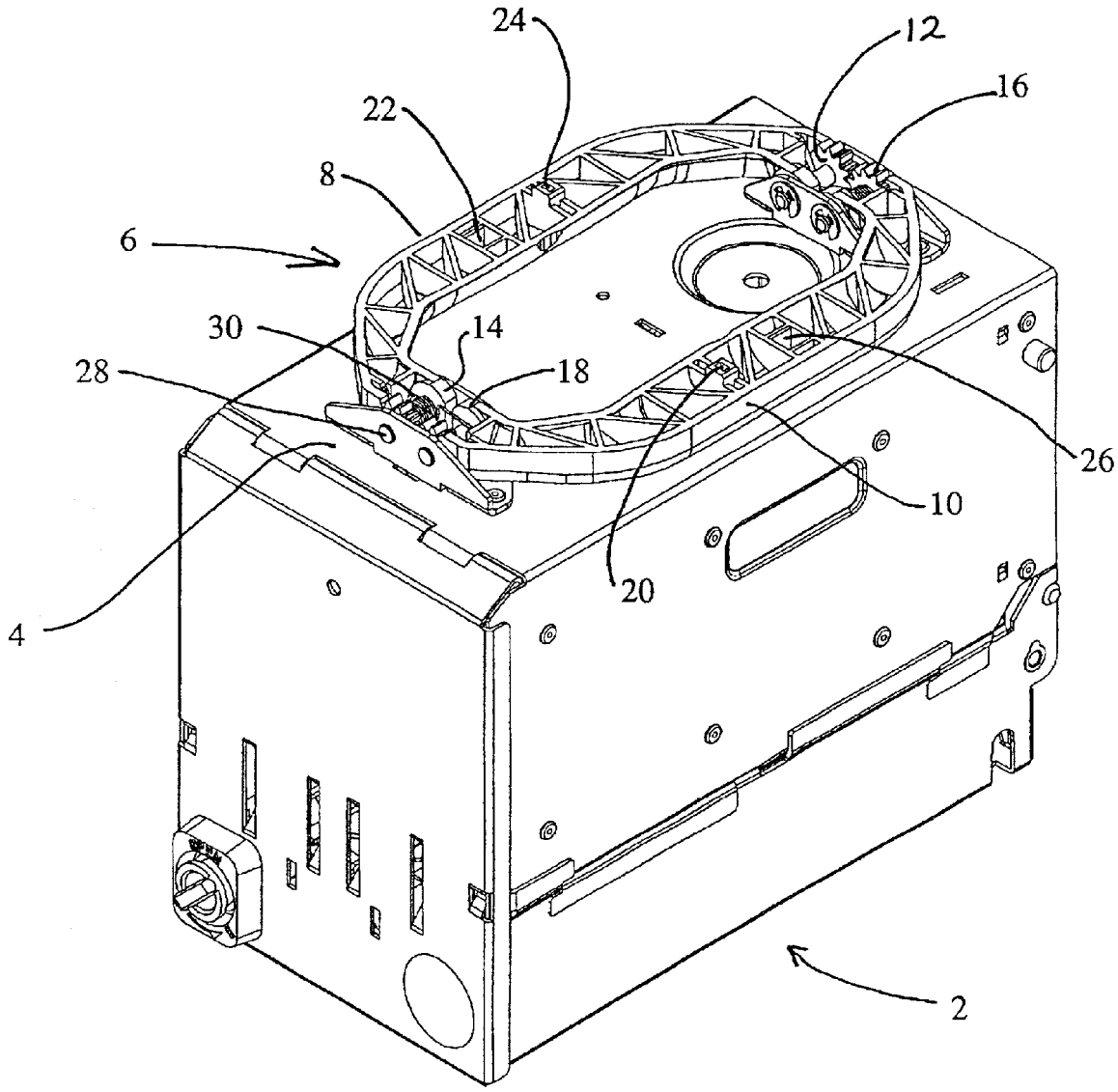
FIG. 1 is a perspective view of the banknote cassette with the foldable handle in a storage position.

The banknote cassette 2, as shown in the Figures, includes a rectangular casing with part of the casing including the planar face 4. A foldable handle 6 is secured on the planar face 4 and is movable from the storage position shown in FIG. 1 to the operating position shown in FIG. 3.

The foldable handle 6 includes identical handle segments 8 and 10 which are secured in an opposed relationship. The one handle is rotated 180 degrees relative to the other handle. In this way, the same handle segment is used for both sides of the foldable handle.

Each handle segment includes fixed gears as part of the handle with each end of the handle segment including a gear. Segment 8 includes fixed gears 12 and 14 whereas handle segment 10 includes fixed gears 16 and 18. Each of the handles is secured to the casing by means of a lock pin 28 which passes through a bracket secured to the face 4 and passes through the end portion 17 or 19 of the handle segment. This pin also passes through the associated fixed gear. Each of the gears includes a cylindrical port 21 through which the lock pin 28 extends.

A torsion spring 30 can be secured to one of the handle segments at one end of the casing and the opposite handle segment at the other end of the casing includes the torsion spring 30. In this way, each handle includes the torsion spring which creates a bias urging the handles to the storage position of FIG. 1. One torsions spring is sufficient, however, two springs are preferred.

The torsion spring is sleeved on the pin 28 and one end of the torsion spring overlies the pin of the adjacent handle. The other end of the torsion spring is engaged by and moves with the opposite handle segment.

Figure 2:
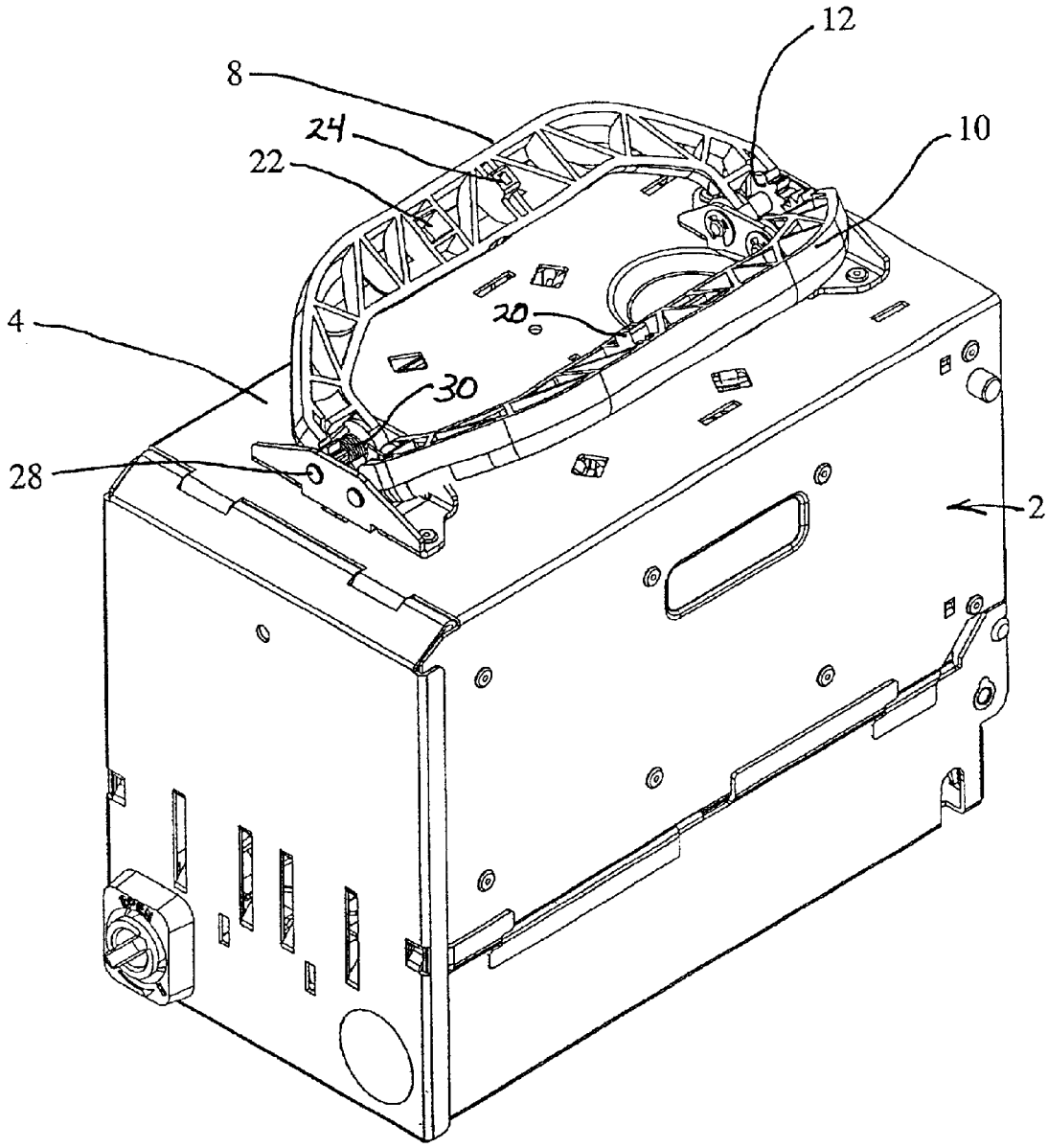
FIG. 2 is a perspective view of the banknote cassette with the foldable handle segments being moved from the storage position to an operating position.
Figure 3:
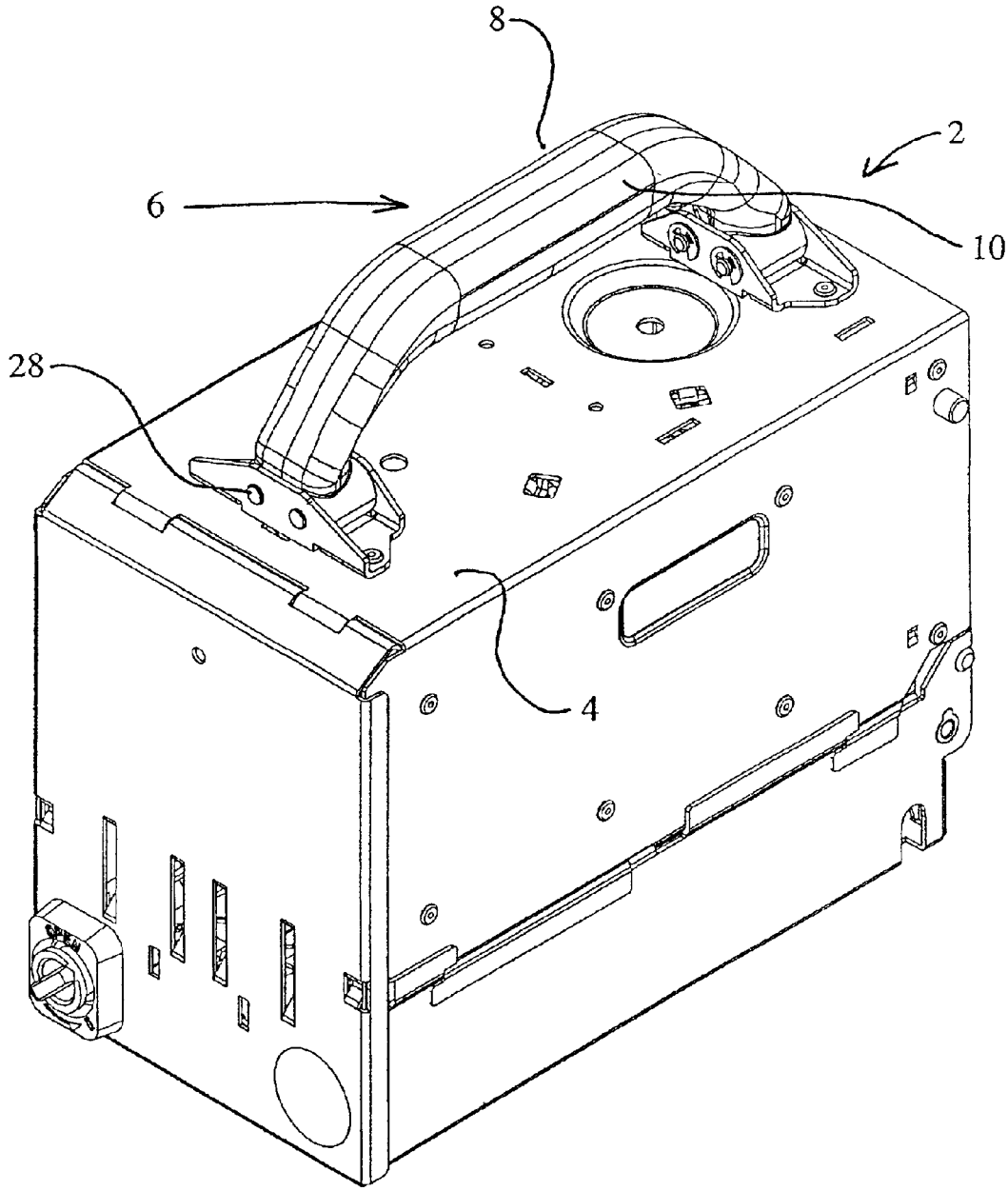
FIG. 3 is a perspective view of the banknote cassette with the handles in the operating position and connected one to the other.
Figure 4:
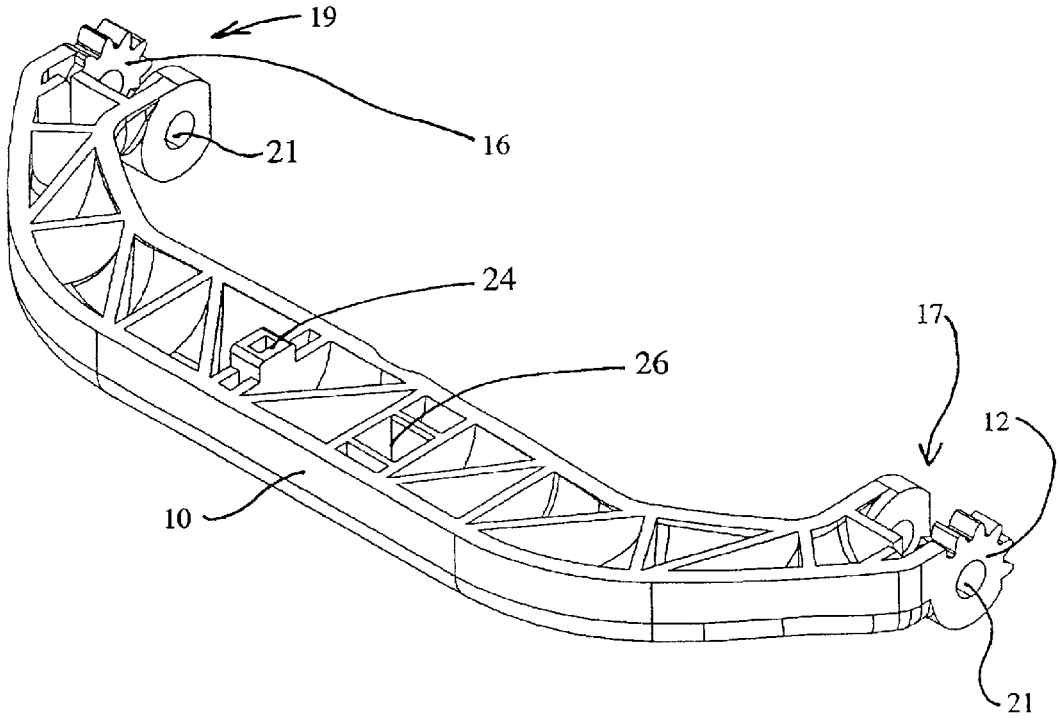
FIG. 4 is a perspective view of a backside of the handle.
Figure 5:
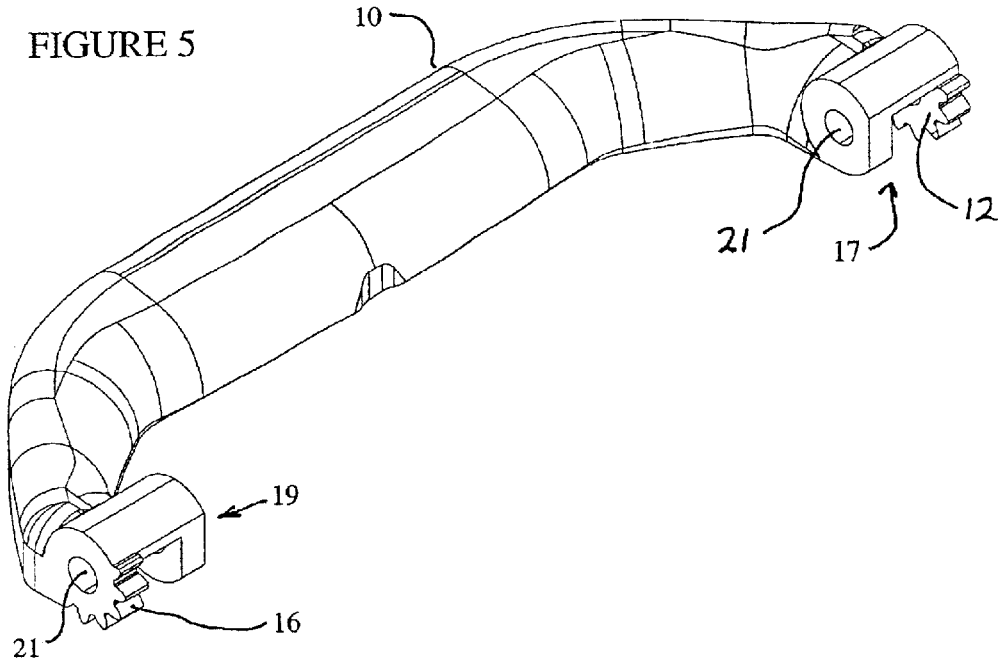
FIG. 5 is a perspective view of a front side of the handle.

As shown in FIGS. 1, 4 and 5, fixed gears 12 and 16 are in mesh and fixed gears 14 and 18 are in mesh. Rotation of one of the handle segments 8 or 10 causes the opposed handle segment to move corresponding but in the opposite direction. Thus movement of one of the handle segments causes the other handle segment to move in relation therewith as indicated in FIG. 2. This movement is opposed by the torsion springs 30 which are being distorted due to movement of the handle segments. Further movement of the handle segments to the locked position shown in FIG. 3 causes further winding of the torsion springs.

Each of the handle segments includes a projecting tab and recess. Handle segment 8 includes projecting tab 24 which is aligned with, and will be received in the recess 26 of the handle segment 10. Handle segment 10 includes projecting tab 24 which will be received in the recess 22 of handle segment 8. A releasable snap fit relationship is provided between the projections 20 and 24 with their respective recesses 22 and 26. In the operative position as shown in FIG. 3, the handle segments are secured one to the other and also have a secured orientation relative to the planar face 4. As can be appreciated, the gears at each end of the handle segment effectively provide a lock maintaining the orientation of the handle relative to the planar face 4. Thus the handle is not freely pivoting relative to the planar face 4 when it is in the locked position of FIG. 3. This secure orientation is advantageous in removing of the banknote cassette, loading of the banknote cassette, movement of the banknote cassette to a transport vehicle or manual transport of a cassette.

As clearly shown in FIGS. 1 and 3, the foldable handle in the storage position of FIG. 1 is flat, such that the amount of additional space required within a device is relatively small. When the handle segments are moved to the operative position as shown in FIG. 3, more space is required but the device is open. When the banknote cassette is placed in an automated payment device, the handle segments move to the storage position and the handle is relatively compact. When the handle is required, the handle segments may be rotated and locked and a positive orientation of the handle relative to the banknote cassette is provided.

The torsion springs 30 in addition to providing a bias moving the handles to the storage position of FIG. 1 also serve to maintain the handles in the storage position and reduce vibration. Such vibration can lead to noise which can be quite annoying during transport of the cassettes if the handles are moved to the storage position. Furthermore, in normal use, the springs also reduce noise caused by vibration.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A banknote cassette for storing of banknotes in a stacked manner, said cassette comprising a generally rectangular case having a slot through which banknotes are received and stacked interior to said case, said case including a foldable handle secured to a face of said rectangular case, said foldable handle being movable from a storage position generally parallel to said face to a lockable operating position with said handle generally perpendicular to said face; said foldable handle includes a spring bias arrangement urging said handle to said storage position and wherein said handle in said operating position cooperates with said cassette to lock said handle and maintain said handle in said locked position and includes a release arrangement to release said handle from said locked position and move under said spring bias arrangement to said storage position.

2. A banknote cassette for storing of banknotes in a stacked manner, said cassette comprising a generally rectangular case having a slot through which banknotes are received and stacked interior to said case, said case including a foldable handle secured to a face of said rectangular case, said foldable handle being movable from a storage position generally parallel to said face to a lockable operating position with said handle generally perpendicular to said face; and wherein said handle includes two opposed handle segments with each segment including a gear portion and said gear portions are in mesh such that movement of one handle segment between said storage and operative position causes a corresponding movement of the other handle segment.

3. A banknote cassette as claimed in claim 2 wherein said handle segments are identical.

4. A banknote cassette as claimed in claim 3 wherein each handle segment is U shaped and attached to said face at opposite ends of each segment.

5. A banknote cassette as claimed in claim 2 wherein each handle segment includes a projecting releasable locking tab and a locking recess located such that the projecting locking tab of one handle segment is received in the locking recess of the other handle segment when said handle segments are moved to said operating position.

6. A banknote cassette as claimed in claim 5 wherein said handle segments are an injected molded plastic handle segment which is pivotally secured to said face at opposite ends of said handle segment.

7. A banknote cassette as claimed in claim 6 wherein each handle segment includes fixed gear members at opposite ends of the handle segment which mesh with corresponding gears of the opposed handle segment.

* * * * *